US009289043B1

(12) United States Patent
Hantman

(10) Patent No.: US 9,289,043 B1
(45) Date of Patent: Mar. 22, 2016

(54) SYSTEMS AND METHODS FOR PROVIDING PROTECTIVE COVERS

(71) Applicant: The Gussy, LLC, Upper Marlboro, MD (US)

(72) Inventor: Jamie E. Hantman, Upper Marlboro, MD (US)

(73) Assignee: The Gussy, LLC, Upper Marlboro, MD (US)

( * ) Notice: Subject to any disclaimer, the term of this patent is extended or adjusted under 35 U.S.C. 154(b) by 0 days.

(21) Appl. No.: 14/271,296

(22) Filed: May 6, 2014

Related U.S. Application Data

(60) Provisional application No. 61/845,834, filed on Jul. 12, 2013.

(51) Int. Cl.
*A45C 3/08* (2006.01)
*A45C 13/00* (2006.01)

(52) U.S. Cl.
CPC ..... *A45C 13/002* (2013.01)

(58) Field of Classification Search
CPC ..... A45C 13/02; A45C 13/002; A45C 3/08
USPC ..... 150/103–105, 154; 190/26; 383/119, 383/110; 217/124; 220/908
See application file for complete search history.

(56) References Cited

U.S. PATENT DOCUMENTS

| | | | | | |
|---|---|---|---|---|---|
| 2,647,595 | A * | 8/1953 | Meyers | 190/26 |
| 3,349,992 | A * | 10/1967 | Skinner | 150/154 |
| 4,026,339 | A * | 5/1977 | Burke | 150/110 |
| 5,172,795 | A * | 12/1992 | Riceman | 190/26 |
| D513,879 | S * | 1/2006 | Waples | D3/321 |
| 7,117,991 | B2 * | 10/2006 | Waring | 206/45.2 |
| 7,789,114 | B2 * | 9/2010 | Pace et al. | 150/105 |
| D667,635 | S * | 9/2012 | Sanchez | D3/318 |
| 2004/0206431 | A1 * | 10/2004 | Metzig et al. | 150/154 |
| 2007/0204943 | A1 * | 9/2007 | Beakey | 150/154 |
| 2010/0282379 | A1 * | 11/2010 | Piper | 150/154 |
| 2012/0011691 | A1 * | 1/2012 | Hasegawa | 29/33 R |
| 2012/0199594 | A1 * | 8/2012 | Pernarella | 220/694 |

* cited by examiner

*Primary Examiner* — Sue A Weaver
(74) *Attorney, Agent, or Firm* — Orrick, Herrington & Sutcliffe

(57) ABSTRACT

A covering for protecting handbags, suitcases and other containers from damage due to inclement weather conditions, such as rain, and methods for making and using same. The protective covering preferably is manufactured from a water-resistant material and is adapted to be draped over a wide variety of containers within a broad range of external dimensions. The protective covering can include first and second opposite side portions, which define a central opening. When the protective covering is draped over a selected container, the central opening receives a handle of the selected container. One or more connector flaps extend from the first side portion adjacent to the central opening. Each of the connector flaps extend across the central opening, adjacent to the handle, and engage the second side portion. The protective cover thereby is secured to the selected container and can protect the selected container from the inclement weather conditions.

17 Claims, 14 Drawing Sheets

SYSTEMS AND METHODS FOR PROVIDING PROTECTIVE COVERS

CROSS-REFERENCE TO RELATED APPLICATIONS

The present application claims priority to U.S. Provisional Patent Application Ser. No. 61/845,834, filed Jul. 12, 2013, which is incorporated by reference herein in its entirety and for all purposes.

FIELD

The disclosed embodiments relate generally to protective coverings, and more specifically, but not exclusively, to protective covers for shielding handbags, suitcases, and other containers from rain and other inclement weather conditions.

BACKGROUND

Consumers spend hundreds—and sometimes thousands—of dollars for the luxury of a designer handbag. In recent years, the cost for these designer handbags have consistently increased with the price of many bags far outpacing both inflation and the market-wide price increases for non-luxury items. For example, a Louis Vuitton Speedy Bag® now starts at about $855—a price increase of almost 53% in less than a decade.

According to the Business of Fashion, many marquee handbags have had price increases of 50-60% in the past decade, and the market for luxury accessories continues to expand. Often, these handbags are made with materials, such as leather, suede, and cotton, which are susceptible to natural forces, such as weather. Exposure to sun, rain, snow, and damp conditions are only a few examples of natural forces that can damage the expensive handbags. Once damaged, cleaning and restoration of such handbags is not only impractical, but can drastically reduce the value of the handbag.

One conventional manner for protecting the handbag, and the contents stored within, includes protective garments. Unfortunately, when available, these protective garments are customized to accommodate only a specific bag, not a variety of bags. Even more, if able to fully fit around the specific bag, it is rare that the handle of the handbag is accessible through the protective garment. When the handles of the handbag are completely covered by the protective garment, the user is forced to carry the handbag in an uncomfortable position.

As the market for luxury accessories continues to grow, an increasing number of expensive handbags are becoming susceptible to inclement weather and other uncontrollable forces. Accordingly, a need exists for improved systems and methods for water-resistant, protective coverings to overcome the aforementioned obstacles and deficiencies of prior art systems.

BRIEF DESCRIPTION OF THE DRAWINGS

The accompanying drawings, which are included as part of the present specification, illustrate the presently preferred embodiments and, together with the general description given above and the detailed description of the preferred embodiment given below, serve to explain and teach the principles described herein.

Figure 1:
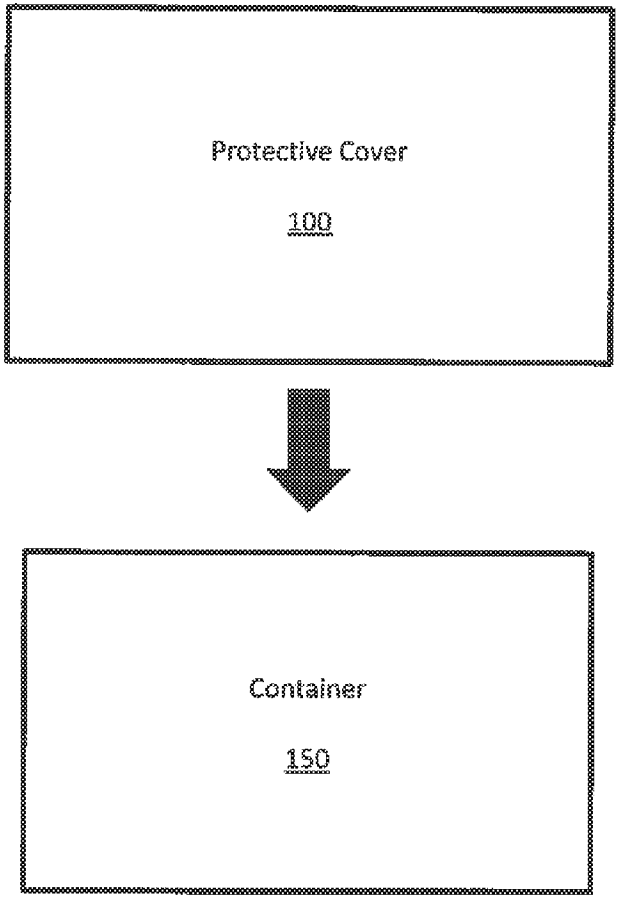
FIG. 1 is an exemplary top-level block diagram illustrating an embodiment of a protective cover suitable for use among a plurality of containers having varying sizes.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not describe every aspect of the teachings disclosed herein and do not limit the scope of the claims.

DETAILED DESCRIPTION OF PREFERRED EMBODIMENTS

Since conventional covers for containers—such as handbags—and the contents within are made to accommodate only a specific container, and rarely accommodate a handle of the specific container, thereby forcing a user to carry the container in an uncomfortable position, a protective cover that can be interchangeably used to protect a variety of containers and maintain user comfort can prove desirable. This result can be achieved, according to one embodiment disclosed herein, by a protective cover 100 as illustrated in FIG. 1. Advantageously, the protective cover 100 can be interchangeably used to protect a variety of containers, such as a container 150. For example, the container 150 can include, but is not limited to, a handbag, a "hobo"-style bag, a purse, a barrel, a bowing bag purse, a bucket bag, a doctor's bag, a drawstring purse, a "kiondo" bag, a lighted bag, a messenger bag, a minaudière, a muff, a satchel, a tote, a trapezoid, a suitcase, a backpack, and so on.

Figure 2A:
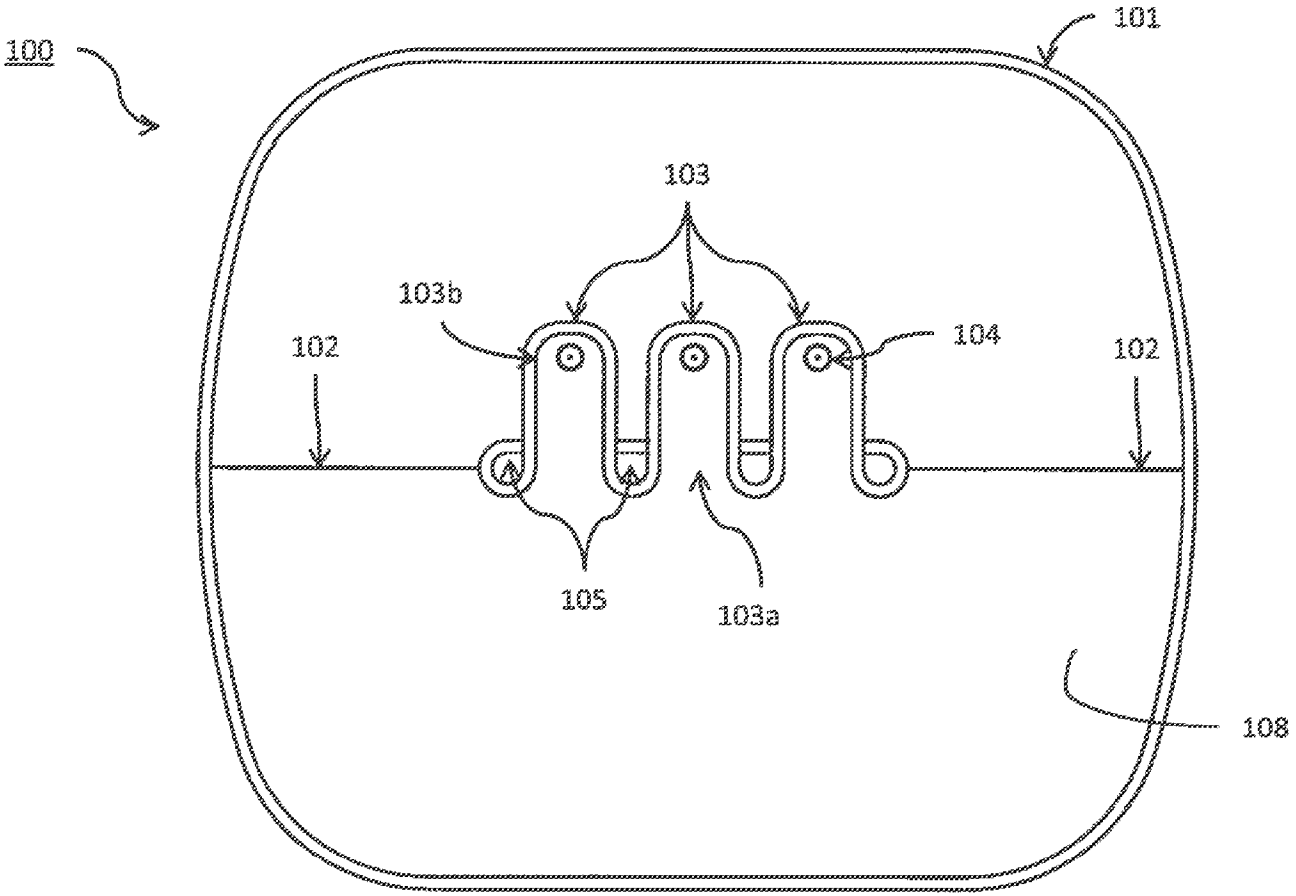
FIG. 2A illustrates a top view of an exemplary embodiment of the protective cover of FIG. 1 for handbags, suitcases, and other containers.

An illustrative embodiment of the protective cover 100 is illustrated in FIGS. 2A-E. Turning to FIG. 2A, the protective cover 100 includes a shroud 101 defining an opening 105. The shroud 101 preferably is made of a waterproof fabric (e.g., vinyl), substantially waterproof (or water-resistant) fabric, and/or a treated fabric. As used throughout, the term waterproof is understood to include water-resistant and/or being unaffected by water or resisting the ingress of water under specific conditions. Treated fabrics include natural and/or synthetic materials that are laminated and/or coated with a water-resistant material such as rubber, polyvinyl chloride (PVC), polyurethane (PU), silicone elastomer, fluoropolymers, wax, and so on, without limitation.

The protective cover 100 is shown as further including one or more connector flaps 103 for extending over the opening 105. FIG. 2A shows three connector flaps 103 for illustration purposes only; however, it should be understood that the protective cover 100 can include any suitable number of connector flaps 103. As shown in FIG. 2A, the connector flaps 103 are provided at a selected region 103*a* of the shroud 101. As illustrated, the connector flaps 103 are fixed on the selected region 103*a* to the shroud 101. On the distal region 103*b* of the connector flaps 103, the connector flaps 103 can be removably coupled with the shroud 101. For example, Velcro®, thread, zippers, buttons, and other "hook-and-loop" type fasteners can be disposed on an internal surface (not shown) of the connector flaps 103 to removably couple the distal region 103*b* of the connector flaps 103 with an external surface 108 of the shroud 101.

In one embodiment, guide markers 104 indicate to a user the portions of the connector flaps 103 (e.g., on the internal surface) that can be secured to the external surface 108 of the shroud 101. The guide markers 104 may further include "fake" buttons or other indicia (e.g., on an external surface of the connector flaps 103) that appear to fasten the connector flaps 103 to the shroud 101. Advantageously, the "fake" buttons or other indicia—although not necessarily received by another fastener—function to guide the user to the region of the connector flaps 103 (e.g., distal region 103*b*) that can be coupled to the shroud 101, while preserving the aesthetics of the protective cover 100.

The shroud 101 further can be folded along an axis 102. The axis 102 is illustrated in FIG. 2A as being disposed adjacent to the opening 105 and extends from opposite sides of the opening 105 to the perimeter of the shroud 101.

Figure 2B:
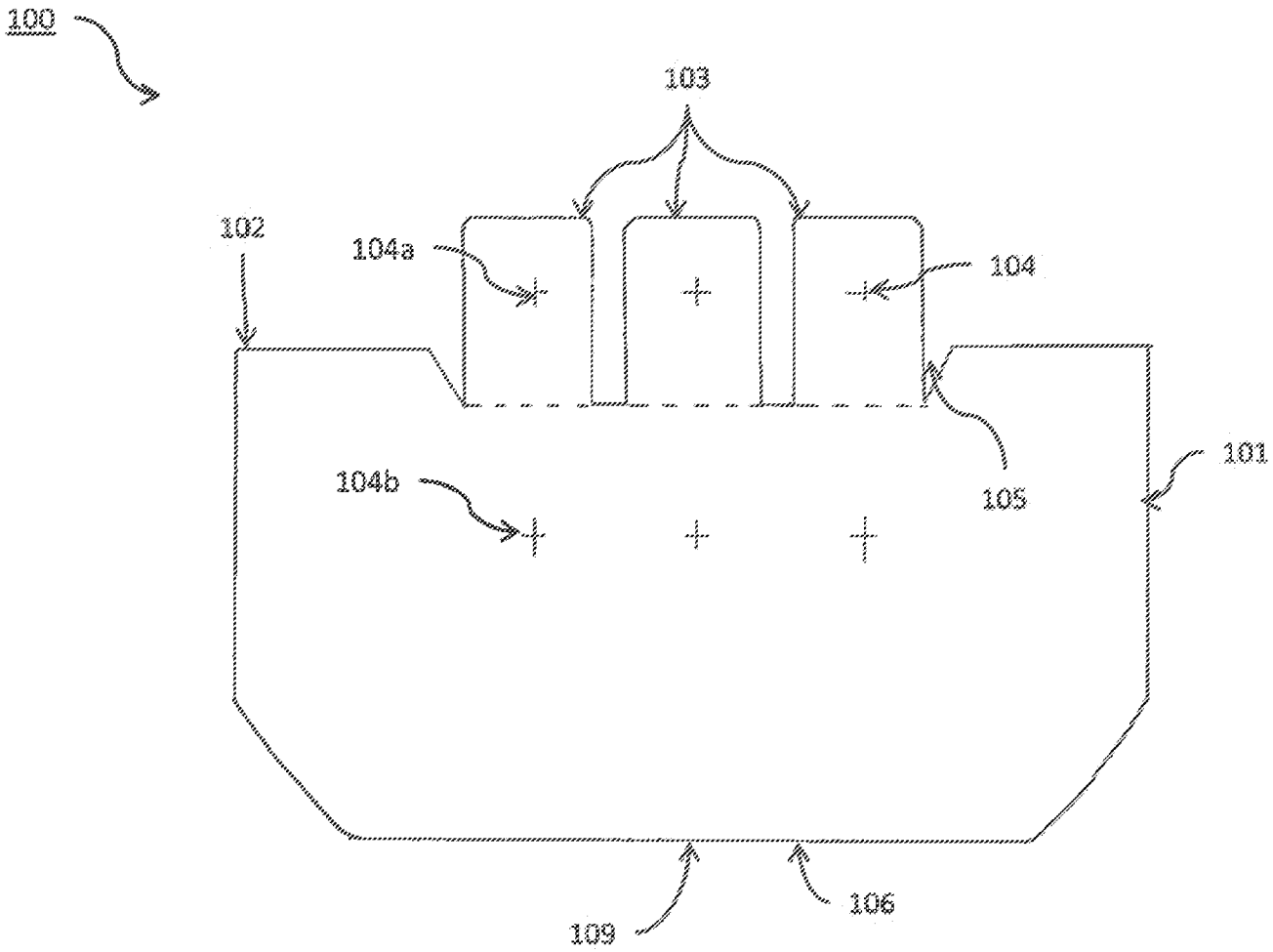
FIG. 2B illustrates a side view of the protective cover of FIG. 2A.
Figure 4A:
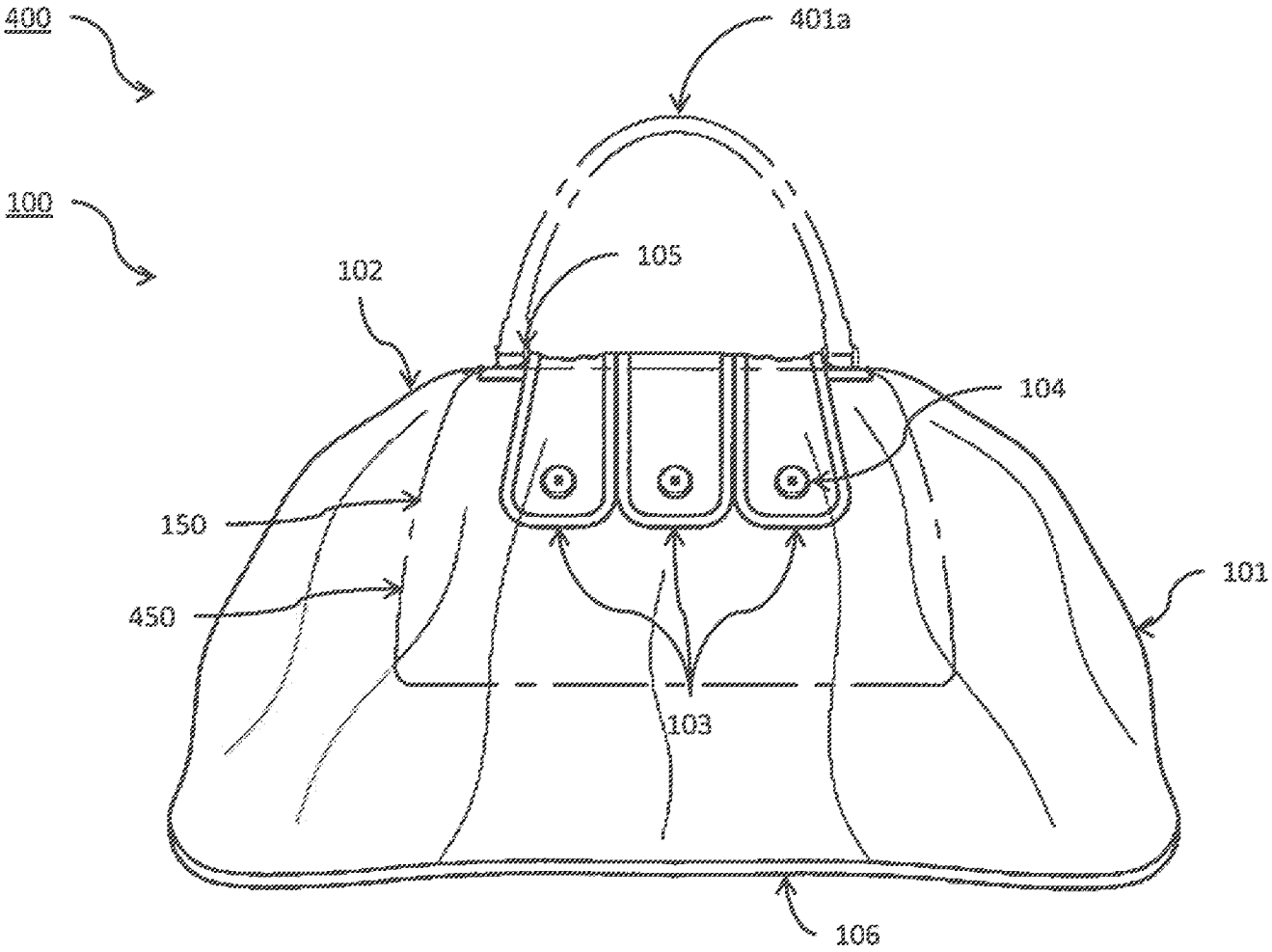
FIG. 4A illustrates an exemplary application of the protective cover of FIGS. 2A-2E.
Figure 4C:
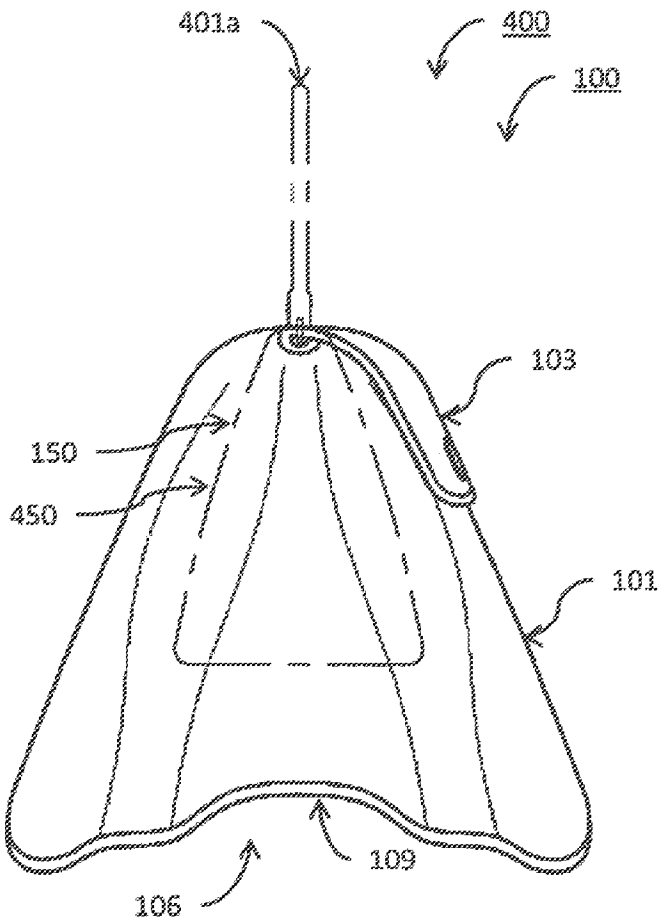
FIG. 4C illustrates a side view of the exemplary application of the protective cover of FIGS. 2A-2E as shown in FIG. 4A.
Figure 4B:
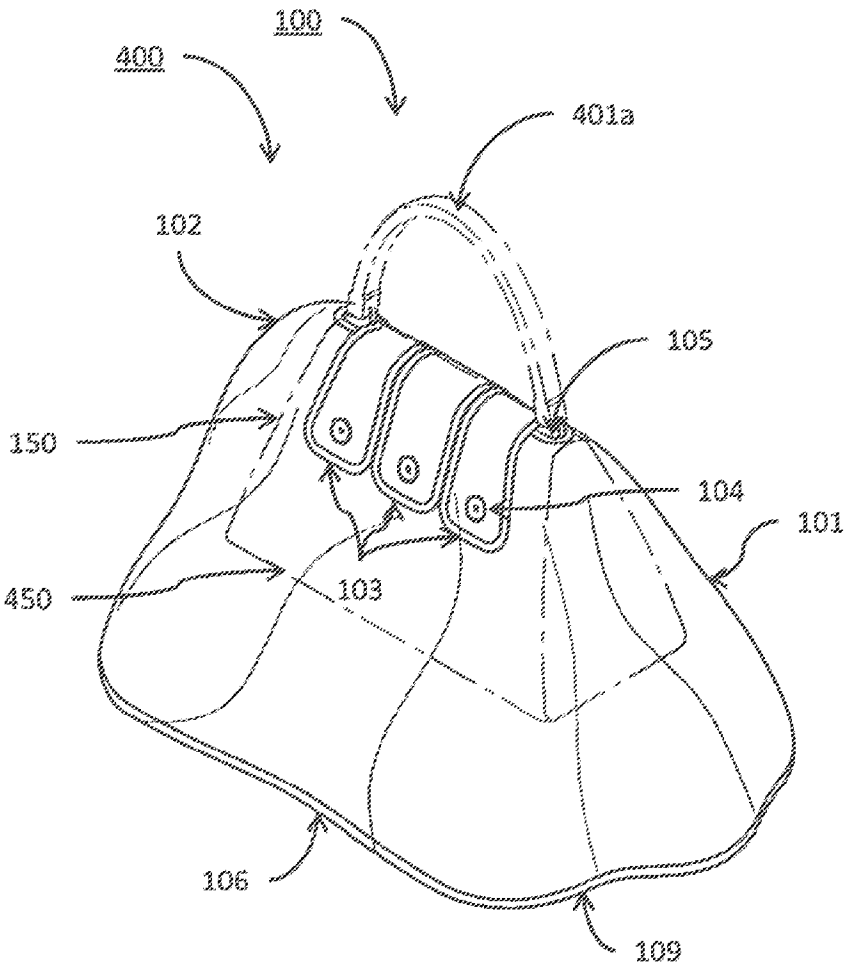
FIG. 4B illustrates a perspective view of the exemplary application of the protective cover of FIGS. 2A-2E as shown in FIG. 4A.
Figure 5A:
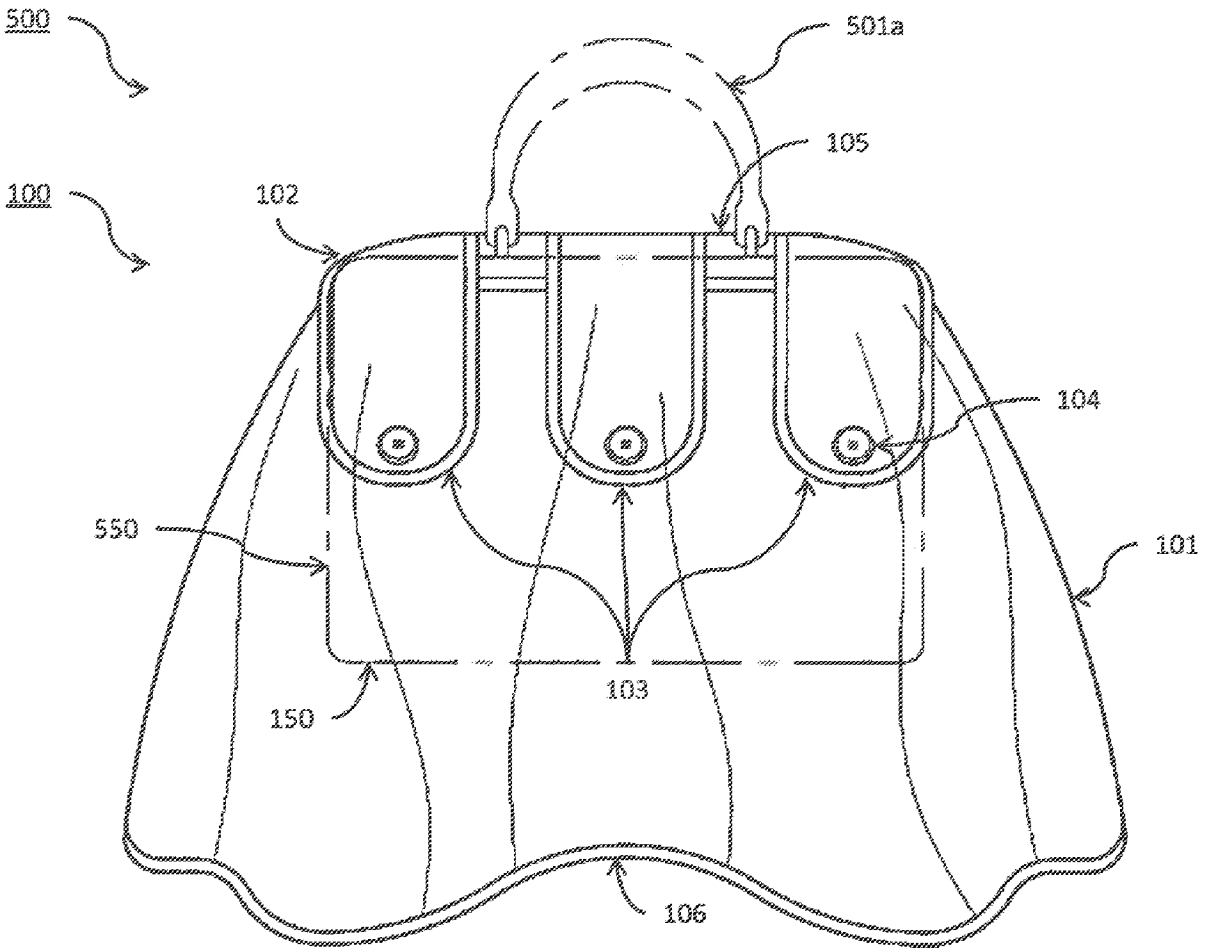
FIG. 5A illustrates an alternative exemplary application of the protective cover of FIGS. 2A-2E.
Figure 5C:
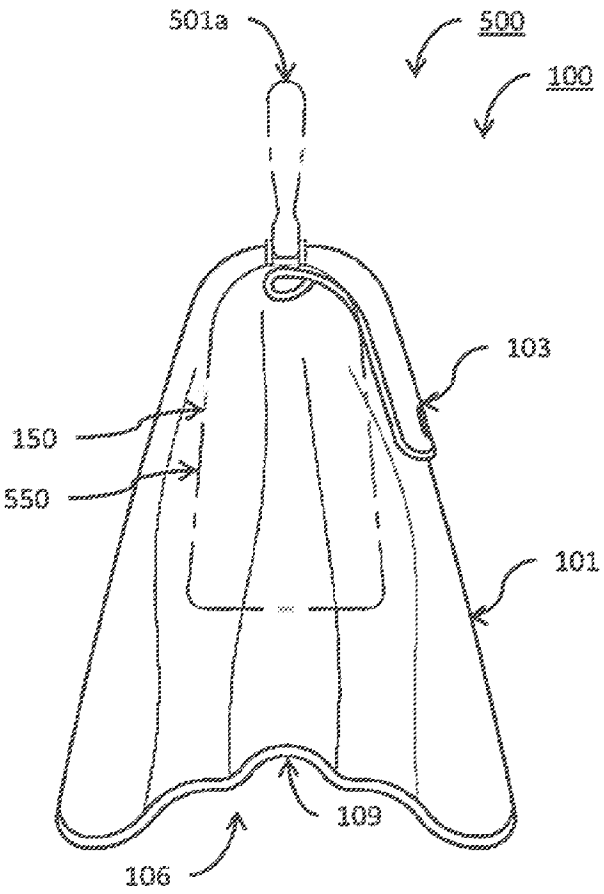
FIG. 5C illustrates a side view of the exemplary application of the protective cover of FIGS. 2A-2E as shown in FIG. 5A.
Figure 5B:
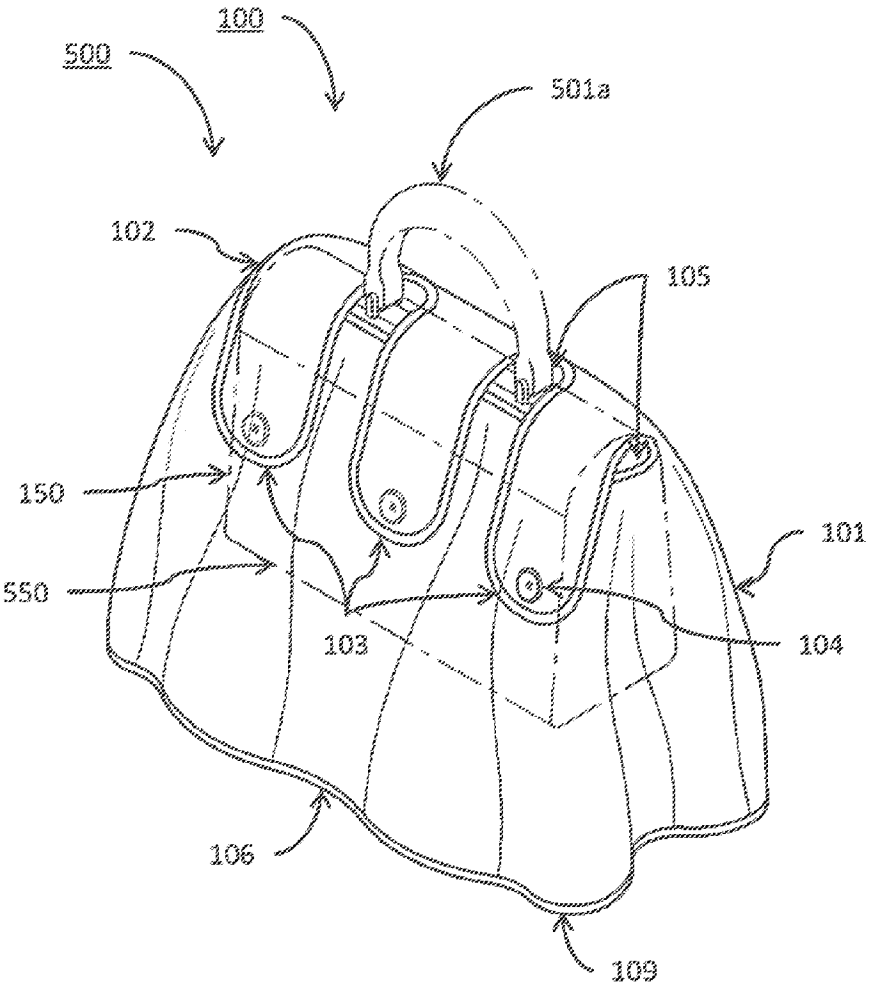
FIG. 5B illustrates a perspective view of the exemplary application of the protective cover of FIGS. 2A-2E as shown in FIG. 5A.

FIG. 2B shows a side view of the protective cover 100 of FIG. 2A, wherein the protective cover 100 is folded along the axis 102. In the manner set forth above with reference to FIG. 2A, once folded along the axis 102, the protective cover 100 remains exposed at the opening 105 for receiving a handle (such as a handle 401*a* shown in FIGS. 4A-C or a handle 501*a* as shown in FIGS. 5A-C) of the container 150. Stated in another way, when the protective cover 100 is draped over the container 150, the opening 105 provides accessibility to the handle of the container 150.

In the folded position (folded at axis 102), a cavity 109 is formed via a bottom opening 106. The bottom opening 106 provides an aperture or gap for receiving the container 150 to be protected into the cavity 109. In this manner, the protective cover 100 can easily be draped (or slipped) over containers of various sizes via the opening 106. Furthermore, in a preferred embodiment, the cavity 109 can be formed such that the protective cover 100 provides a 360-degree coverage of the container 150 (shown in FIGS. 4A-C and FIGS. 5A-C). Stated in another way, a portion of the protective cover 100 that is folded at the hinge 102 can hang at the sides of the container 150 to provide additional protection (i.e., not only protection in two planes).

As discussed with reference to FIGS. 2A-B, the connector flaps 103 can be removably coupled to the shroud 101 such that a guide marker 104*a* on the connector flap 103 and a guide marker 104*b* on the shroud 101 are temporarily affixed (e.g., via Velcro® as discussed above). As will be discussed in further detail below, when connector flaps 103 are temporarily affixed via guide markers 104*a*/104*b*, the protective cover 100 is secured in place to the container 150.

Figure 2C:
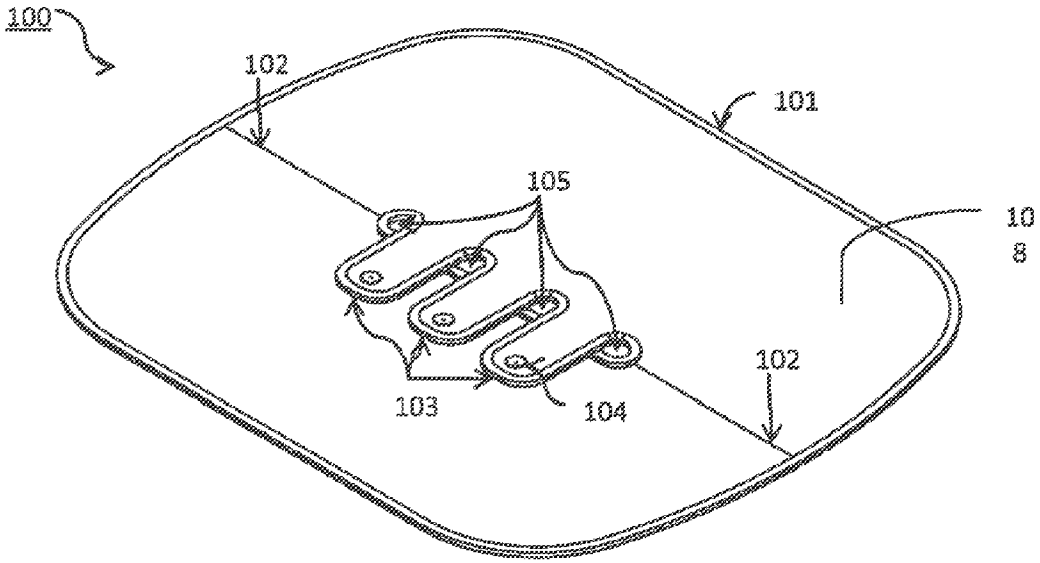
FIG. 2C illustrates a perspective view of the protective cover of FIG. 2A.
Figure 2D:
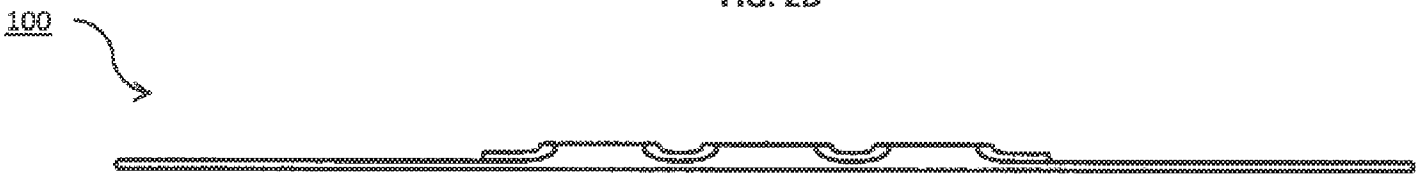
FIG. 2D illustrates a second side view of the protective cover of FIG. 2A.
Figure 2E:
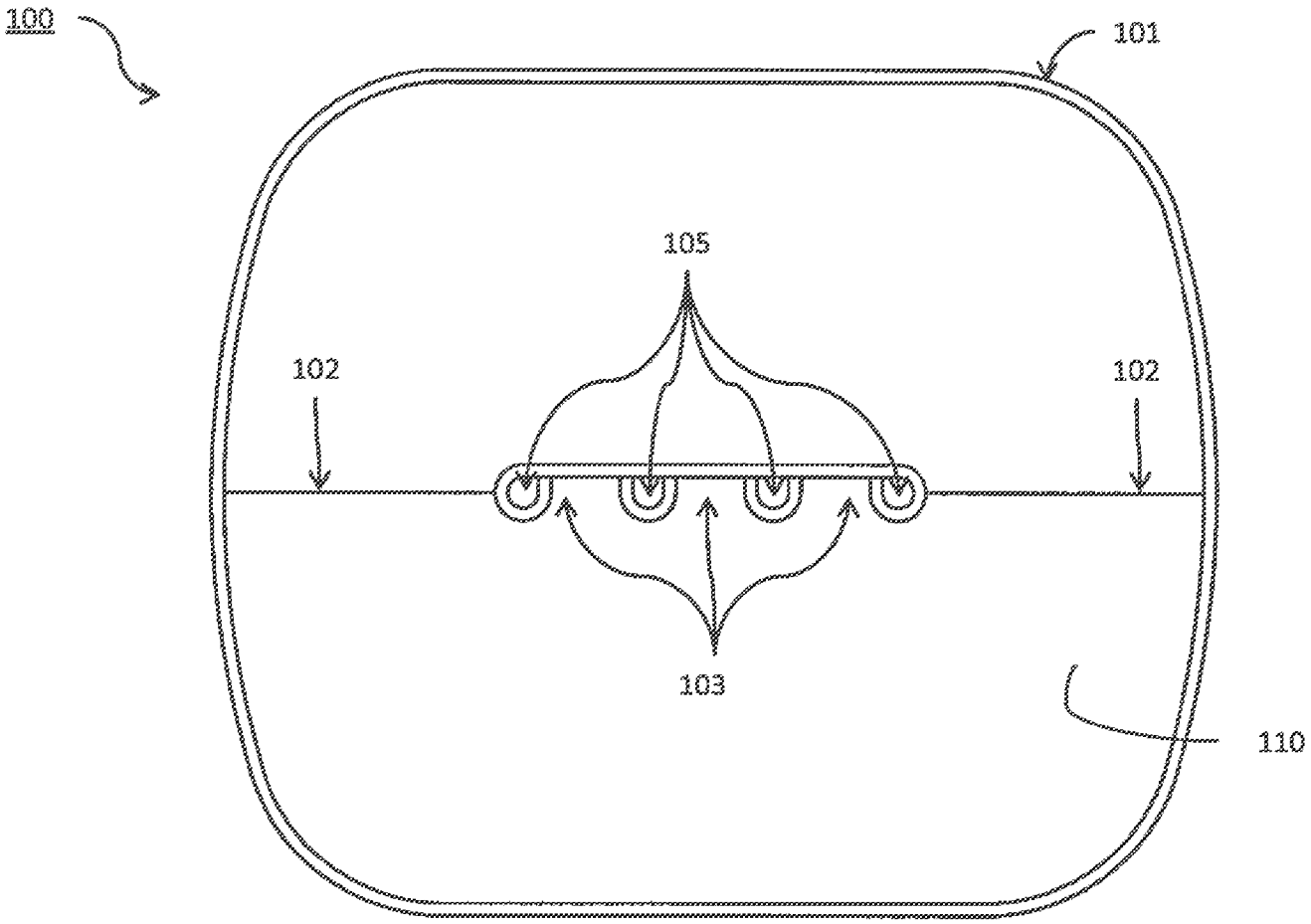
FIG. 2E illustrates a bottom view of the protective cover of FIG. 2A.

FIG. 2C shows a perspective view of the protective cover 100 of FIG. 2A, wherein the protective cover 100 is open in the manner illustrated in FIG. 2A. FIG. 2D illustrates a second side view of the protective cover 100 of FIG. 2A, wherein the protective cover 100 is folded along the axis 102 as shown in FIG. 2B. FIG. 2E shows a bottom view illustrating an internal surface 110 of the protective cover 100 of FIG. 2A, wherein the protective cover 100 is open in the manner illustrated in FIGS. 2A and 2C.

Figure 3:
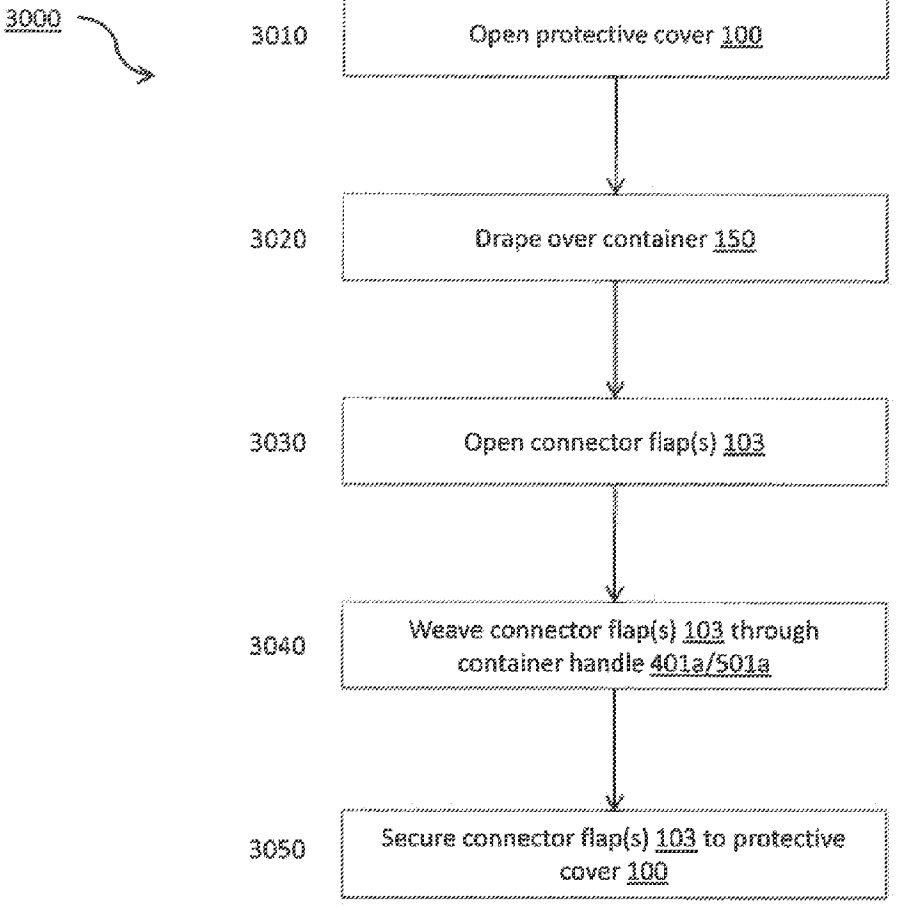
FIG. 3 illustrates an exemplary embodiment of a method of applying the protective cover to the container as shown in FIG. 1.

An exemplary process 3000 for using the protective cover 100 with the container 150 is illustrated with reference to FIG. 3. The protective cover 100 is first opened, at 3010 (such as to the top view shown in FIG. 2A, the perspective view shown in FIG. 2C, and the bottom view show in FIG. 2E). The protective cover 100 can be draped (or slipped) over the container 150 by folding along the axis 102 (shown in FIGS. 2B and 2D) and placing the container 150 into the cavity 109 via the bottom opening 106, at 3020. If the connector flaps 103 are in a closed position (e.g., secured to the shroud 101 via Velcro®), a predetermined number of connector flaps 103 are opened to expose a handle (if container 150 includes a handle) of the container 150, at 3030.

For example, if the container 150 (e.g., a handbag) to be protected has a wide handle, all three connector flaps 103 can be opened, and the wide handle can be slipped through the opening 105. The connector flaps 103 can be threaded through the handle, at 3040 and secured to the corresponding location (e.g., guide marker 104*b*) of the shroud 101, at 3050. FIGS. 4A-C illustrate an application 400 of the protective cover 100 for a larger container 450 having a wider handle 401*a*. As shown in FIG. 4A, all three connector flaps 103 are threaded through the gap of the wider handle 401*a* and secured to the shroud 101 via guide markers 104. FIG. 4B shows a perspective view of the application 400 and FIG. 4C shows a side view of the application 400.

Alternatively, if the container 150 has a smaller top handle, only the middle connector flap 103 advantageously can be opened, at 3030, to accommodate the smaller top handle before threading the middle connector flap 103 through a gap between the handle and the container, at 3040. For the smaller top handle, the outside connector flaps 103 are not necessary for fitting the container handle through the opening 105. With reference to FIGS. 5A-C, an application 500 shows a smaller container 550, such as a small handbag, being fully protected by the protective cover 100. The protective cover 100 is slipped over the smaller container via opening 106 into the cavity 109, at 3020. The smaller container 550 has a small handle 501*a* that can be accessible through the opening 105 of the protective cover 100. As illustrated in FIG. 5A, only the middle connector flap 103 is threaded through the gap between the small handle 501*a* and the smaller container 550, at 3040, and removably secured to the shroud 101 via guide markers 104, at 3050. FIG. 5B shows a perspective view of the application 500 and FIG. 5C shows a side view of the application 500.

Advantageously, the container 150 can be fully protected by the protective cover 100. The waterproof material of shroud 101 keeps the container substantially free from any damage caused by inclement weather conditions (e.g., rain, snow, humidity). As an additional advantage, providing one or more connector flaps 103 enables the protective cover 100 to accommodate a variety of container (e.g., handbag) styles by providing multiple sizing options for disposing the handle of a selected container within the top opening 105.

Figure 6:
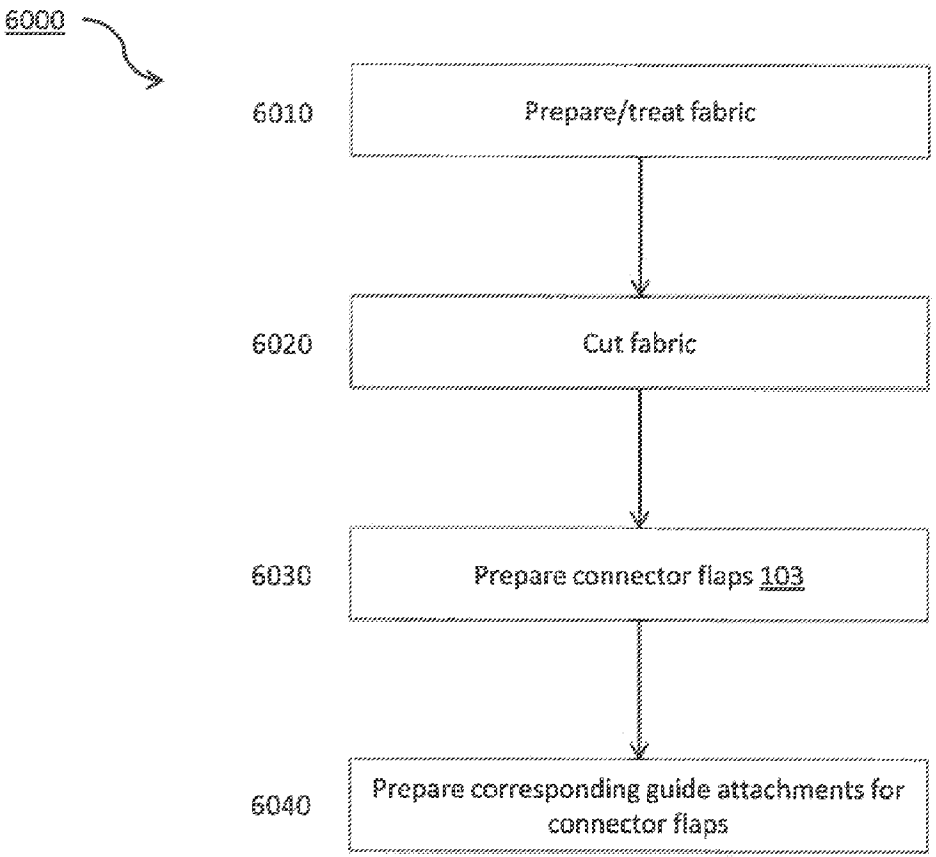
FIG. 6 illustrates an exemplary embodiment of a method of manufacturing the protective cover of FIGS. 2A-2E.

Turning to FIG. 6, an exemplary process 6000 of manufacturing the protective cover 100 is shown. As previously discussed, the shroud 101 includes material that is waterproof. The material for shroud 101 is first waterproofed, at 6010. The prepared/treated fabric for shroud 101, at 6020, is cut (or trimmed) into a predetermined shape, such as the oval/rectangular shape (illustrated in FIGS. 2A-E). The opening 105 is formed into the predetermined shape. Preferably, the opening 105 is formed in the center of the shroud 101. In one embodiment, the connector flaps 103 can be cut from the same predetermined shape (such as shown in FIGS. 2A-E). The connector flaps 103 are formed adjacent to the opening 105 to a predetermined length that can extend beyond the width of the opening 105. In another embodiment, the connector flaps 103 can be separately formed and coupled to the predetermined shape.

At 6030, a connector material (e.g., Velcro®) is placed on the internal surface (i.e., when the protective cover 100 is folded along the axis 102, the internal surface refers to the side of the connector flaps that would contact the shroud 101) of the connector flaps 103 (e.g., at guide markers 104*a* shown in FIG. 2B). At a corresponding spot on the shroud 101 (e.g., at guide markers 104*b* shown in FIG. 2B where the guide markers 104*b* would come into contact with the shroud 101), a corresponding connector material (e.g., Velcro®) is affixed for receiving the prepared connector flaps 103, at 6040.

Figure 7:
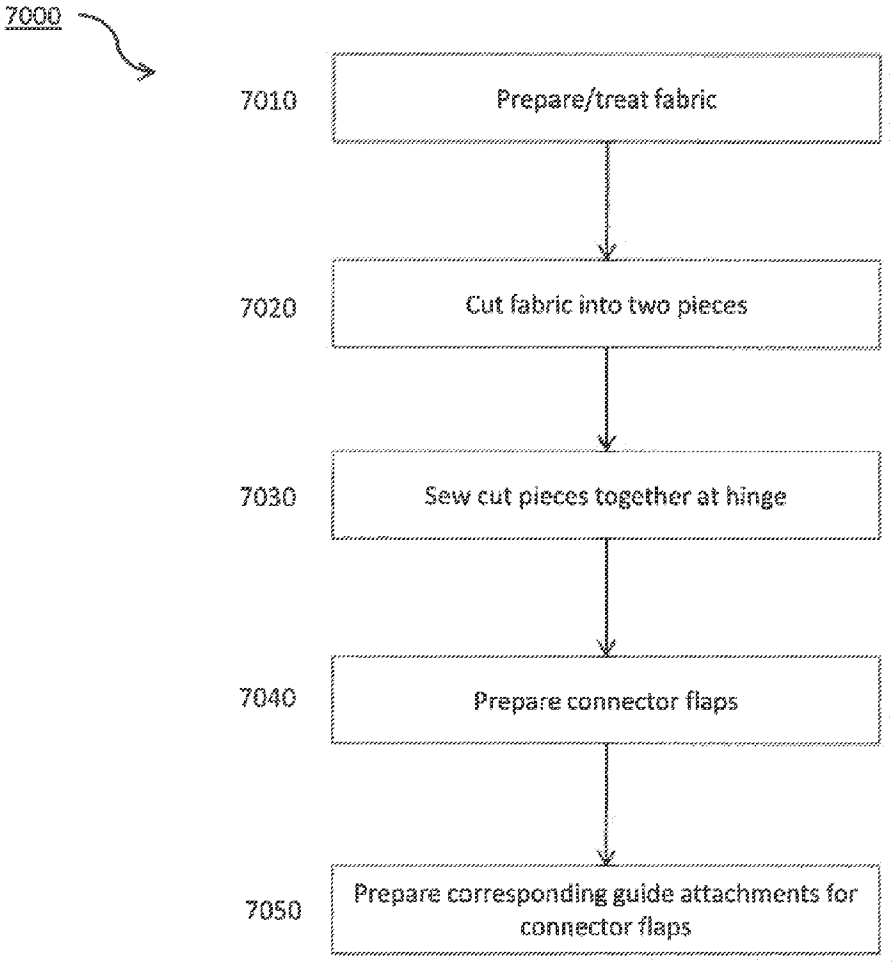
FIG. 7 illustrates an alternative embodiment of the method of manufacturing the protective cover of FIGS. 2A-2E.
Figure 8:
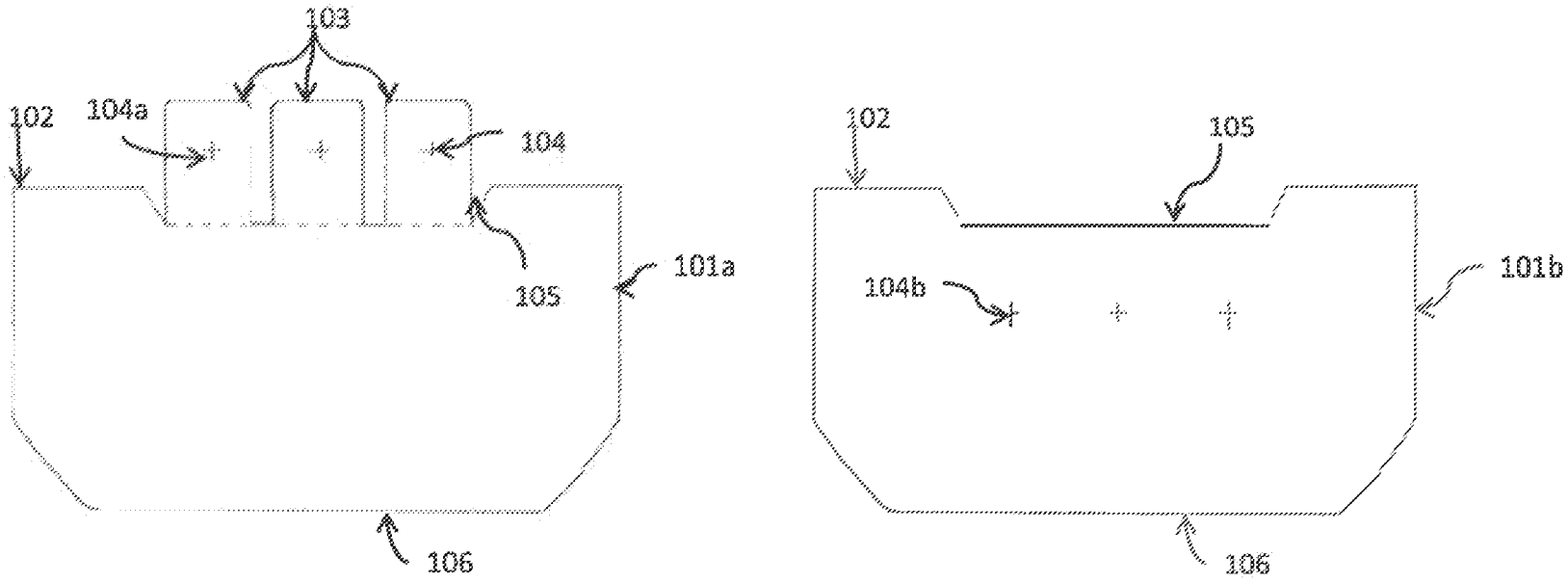
FIG. 8 illustrates an alternative embodiment of the protective cover of FIG. 1, wherein the protective cover includes a front panel shroud and a back panel shroud that are prepared during manufacture in accordance with the method of FIG. 7.

In an alternative embodiment, the shroud 101 can be provided via two separate fabric portions. FIG. 7 illustrates an alternative method 7000 for manufacturing the protective cover 100 using two separate fabric portions. The process 7000 includes, at 7010, treating a single fabric. At 7020, the treated fabric is cut into two portions—for example, a front panel shroud 101*a* and a back panel shroud 101*b* (collectively shown in FIG. 8). The two treated panels 101*a*, 101*b* are nearly identical in shape; however, as shown in FIG. 8, the front panel shroud 101*a* includes the connector flaps 103 extending from the opening 105.

With the two treated panels 101*a*, 101*b*, the panels are coupled (e.g., sewn with thread) along a top portion (e.g., along axis 102), forming the opening 105, at 7030. Connector material (e.g., Velcro®) is placed on both the connector flaps 103 (e.g., at guide markers 104*a* shown in FIG. 2B), at 7040, and the corresponding location of the shroud 101 (e.g., at guide markers 104*b* shown in FIG. 2B), at 7050.

Figure 9:
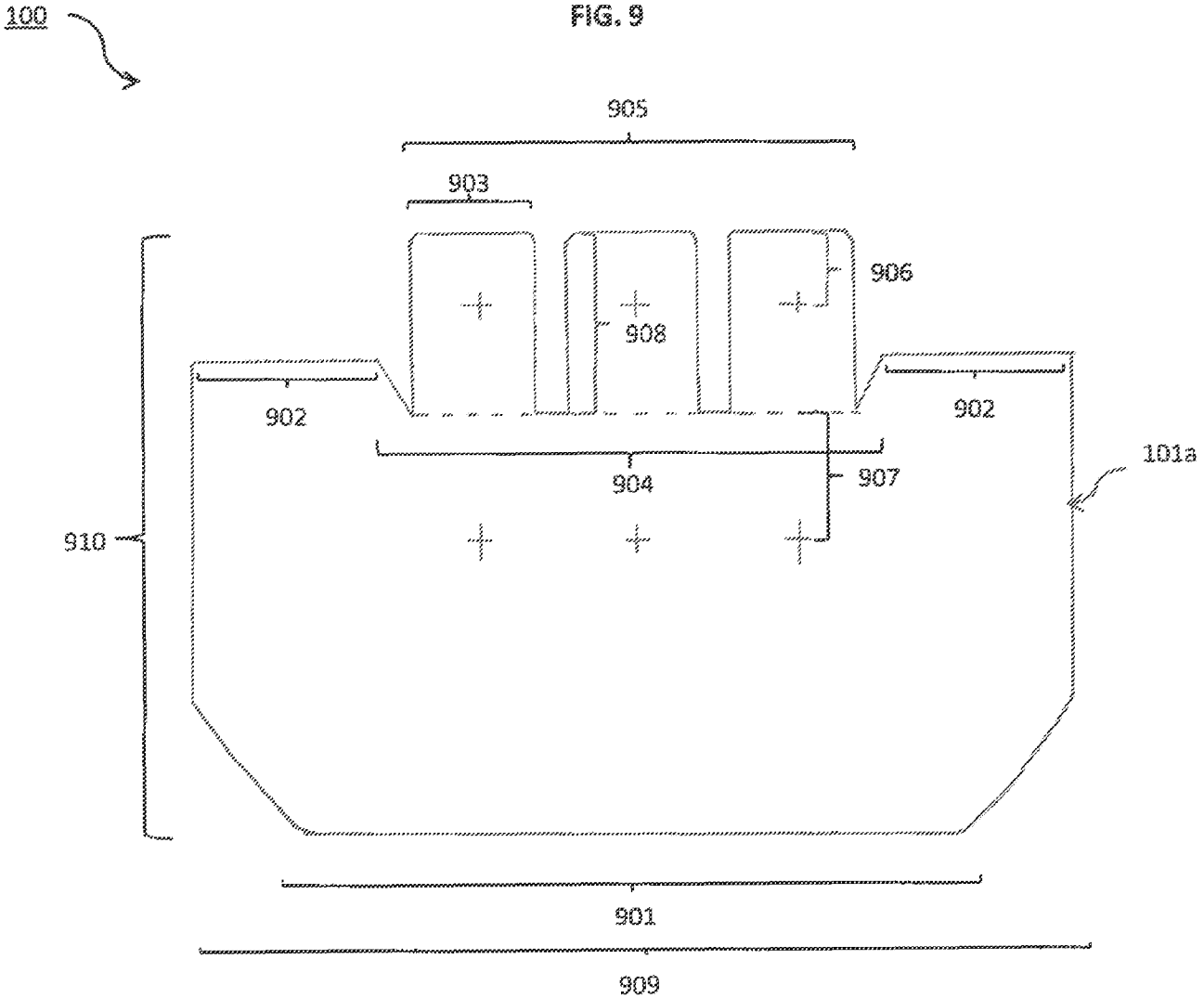
FIG. 9 illustrates an exemplary embodiment of the dimensions of the protective cover shown in FIGS. 2A-E.

In one embodiment, with reference also to FIG. 9, exemplary dimensions for the protective cover 100, as illustrated in FIG. 2B, are provided in Table 1:

TABLE 1

Exemplary dimensions of shroud 101

| Measurement | Size (Inches) |
|---|---|
| Height-From Top Of Flap To Bottom Edge 910 | 23 |
| Top Width-Top Edge/Top Edge 909 | 37 |
| Bottom Width-Edge/Edge 901 | 18 |

TABLE 1-continued

Exemplary dimensions of shroud 101

| Measurement | Size (Inches) |
|---|---|
| Top Opening Width-Edge/Edge 904 | 14 |
| Flap Opening Width 905 | 12 |
| Sew Line Length (Sides Of Top Cover) 902 | 12 |
| Flap Height-Top Edge To Imaginary Fold Line 908 | 7 |
| Flap Width-Edge/Edge 903 | 3½ |
| Flap Velcro Placement-From Top Edge Of Flap To Top Of Velcro 906 | ⅝ |
| Velcro Placement-From Top Edge Of Cover 907 | 4¾ |

In another embodiment, exemplary ranges for dimensions for the protective cover 100, as illustrated in FIG. 9, are provided in Table 2:

TABLE 2

Exemplary ranges of dimensions of shroud 101

| Measurement | Size (Inches) |
|---|---|
| Height-From Top Of Flap To Bottom Edge 910 | 11½-46 |
| Top Width-Top Edge/Top Edge 909 | 18½-74 |
| Bottom Width-Edge/Edge 901 | 9-36 |
| Top Opening Width-Edge/Edge 904 | 7-28 |
| Flap Opening Width 905 | 6-24 |
| Sew Line Length (Sides Of Top Cover) 902 | 6-24 |
| Flap Height-Top Edge To Imaginary Fold Line 908 | 3½-14 |
| Flap Width-Edge/Edge 903 | 1¾-7 |
| Flap Velcro Placement-From Top Edge Of Flap To Top Of Velcro 906 | 0.3-1.25 |
| Velcro Placement-From Top Edge Of Cover 907 | 2.3-9½ |

As desired, the dimensions for the protective cover 100 can be established as a preselected percentage (and/or a preselected percentage range) of the size of the container 150. Exemplary preselected percentage ranges can include between fifty percent (50%) and two hundred (200%) of the size of the container 150, including any percentage sub-ranges, such as a five percent sub-range (e.g., between sixty percent (60%) and seventy percent (70%)) and/or a ten percent sub-range (e.g., between sixty percent (60%) and seventy percent (70%)), within the preselected percentage range, without limitation.

Similarly, the dimensions for the protective cover 100 can be established as a preselected percentage (and/or a preselected percentage range) of the exemplary dimensions of the protective cover 100 provided in Table 1, above. Exemplary preselected percentage ranges can include between fifty percent (50%) two hundred (200%) of the exemplary dimensions of the protective cover 100 provided in Table 1, above, including any percentage sub-ranges, such as a five percent sub-range (e.g., between sixty percent (60%) and seventy percent (70%)) and/or a ten percent sub-range (e.g., between sixty percent (60%) and seventy percent (70%)), within the preselected percentage range, without limitation.

In one embodiment, a protective covering for interchangeably protecting containers of various sizes includes a cover having first and second opposite side portions and defining a central opening between the first and second side portions; and one or more connector flaps extending from the first side portion adjacent to the opening. The cover is adapted to drape over a selected container such that a handle of the selected container is received within the opening and each of the connector flaps extends across the opening and adjacent to the handle, engages the second side portion, and thereby secures the cover to the selected container.

Advantageously, this protective covering can be interchangeably used to protect a variety of containers (e.g., suitcases, handbags), thus, making the protective covering a more versatile, useable product. The protective covering further protects the containers from getting wet and damaged when the user carrying the handbag gets caught in unpredictable weather conditions.

In another embodiment, a method for manufacturing a protective covering includes forming both a first opening at a top portion of a cover and a second opening at a bottom portion of the cover; and fixedly attaching one or more connector flaps for extending through the first opening of the cover, wherein when the one or more connector flaps are secured through the first opening, the top portion forms at least one carrier opening for a handle of a handbag for interchangeably protecting handbags of various sizes.

In the description above, for purposes of explanation only, specific nomenclature is set forth to provide a thorough understanding of the present disclosure. However, it will be apparent to one skilled in the art that these specific details are not required to practice the teachings of the present disclosure.

The language used to disclose various embodiments describes, but should not limit, the scope of the claims. For example, in the previous description, for purposes of clarity and conciseness of the description, not all of the numerous components shown in the figures are described. The numerous components are shown in the drawings to provide a person of ordinary skill in the art a thorough, enabling disclosure of the present specification. The operation of many of the components would be understood and apparent to one skilled in the art. Similarly, the reader is to understand that the specific ordering and combination of process actions described is merely illustrative, and the disclosure may be performed using different or additional process actions, or a different combination of process actions.

Each of the additional features and teachings disclosed herein can be utilized separately or in conjunction with other features and teachings for protective coverings. Representative examples using many of these additional features and teachings, both separately and in combination, are described in further detail with reference to the attached drawings. This detailed description is merely intended for illustration purposes to teach a person of skill in the art further details for practicing preferred aspects of the present teachings and is not intended to limit the scope of the claims. Therefore, combinations of features disclosed in the detailed description may not be necessary to practice the teachings in the broadest sense, and are instead taught merely to describe particularly representative examples of the present disclosure. Additionally and obviously, features may be added or subtracted as desired without departing from the broader spirit and scope of the disclosure. Accordingly, the disclosure is not to be restricted except in light of the attached claims and their equivalents.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

What is claimed is:

1. A protective covering for containers having various sizes, comprising:

a cover having first and second opposite side portions and defining a central opening between said first and second side portions; and three connector flaps extending from said first side portion adjacent to the opening, wherein said cover is adapted to drape over a selected container such that a handle of the selected container is received within the opening, each of said three connector flaps extending across the opening and adjacent to the handle, engaging said second side portion, and thereby securing said cover to the selected container.

2. The protective covering of claim 1, wherein a selected connector flap extends across the opening to engage said second side portions and is disposed between the handle and the selected container.

3. The protective covering of claim 1, wherein at least one of said cover and said connector flaps is made of a waterproof material.

4. The protective covering of claim 3, wherein said waterproof material is selected from a group consisting of vinyl or treated fabric.

5. The protective covering of claim 1, wherein an end region of said connector flaps further comprises a hook and loop fastener for said engaging said second side portion.

6. A protective covering for handbags of various sizes, comprising:

a front cover;

a back cover fixedly coupled to said front cover and forming both a first opening at a top portion of the coupled cover and a second opening at a bottom portion of the coupled cover; and three connector flaps fixedly attached to said front cover for removably securing to said back cover through the first opening of the coupled cover, wherein when said three connector flaps are secured to said back cover, said top portion forms at least one opening for a handle of a selected handbag for interchangeably protecting the handbags of various sizes.

7. The protective covering of claim 6, wherein at least one of said front cover, said back cover, and said connector flaps is made of a waterproof material.

8. The protective covering of claim 7, wherein said waterproof material is selected from a group consisting of vinyl or treated fabric.

9. The protective covering of claim 6, wherein an end region of said connector flaps further comprises a hook and loop fastener for said removably securing to said back cover.

10. A protective covering, comprising:

a sheet having a surface and first and second opposite side portions, said sheet defining a central opening between said first and second side portions; and three connector flaps extending from said first side portion adjacent to the opening and being configured to engage said second side portion, wherein said sheet is malleable such that the surface is adapted to form an internal cavity in communication with the central opening.

11. The protective covering of claim 10, wherein said sheet is adapted to drape over a selected container such that the selected container is received within the internal cavity and a handle of the selected container extends through the opening, each of said connector flaps extending across the opening and adjacent to the handle, engaging said second side portion, and thereby securing said sheet of pliable material to the selected container.

12. The protective covering of claim 11, wherein a selected connector flap extends across the opening to engage said second side portion and is disposed between the handle and the selected container.

13. The protective covering of claim 10, wherein at least one of said sheet and said connector flaps is made of a waterproof material.

14. The protective covering of claim 13, wherein said waterproof material is selected from a group consisting of vinyl or treated fabric.

15. The protective covering of claim 10, wherein an end region of said connector flaps further comprises a hook and loop fastener for said engaging said second side portion.

16. The protective covering of claim 10, wherein an internal surface of an end region of said connector flaps further comprises guide markers for indicating the end region to engage said second side portion.

17. The protective covering of claim 16, wherein said guide markers are selected from a group consisting of buttons and indicia.

* * * * *